United States Patent [19]

Elias et al.

[11] 4,174,253

[45] Nov. 13, 1979

[54] DISSOLUTION OF METALS UTILIZING A $H_2O_2$-$H_2SO_4$ SOLUTION CATALYZED WITH HYDROXY SUBSTITUTED CYCLOPARAFFINS

[75] Inventors: Moenes L. Elias, Canfield, Ohio; Philip D. Readio, Sparta, N.J.

[73] Assignee: Dart Industries Inc., Los Angeles, Calif.

[21] Appl. No.: 849,575

[22] Filed: Nov. 8, 1977

[51] Int. Cl.[2] ..... C23F 1/00

[52] U.S. Cl. ..... 156/666; 156/664; 252/79.4

[58] Field of Search ..... 156/666, 664; 252/180, 252/186, 79.4, 79.2, 100, 95, 175, 145; 423/27, 41, 584, 272, 508, 510; 75/101 R, 115, 117; 134/3, 41

[56] References Cited

U.S. PATENT DOCUMENTS

| | | | |
|---|---|---|---|
| 3,556,883 | 1/1971 | Naito et al. | 156/666 |
| 3,801,512 | 4/1974 | Solenberger | 252/79.4 |
| 4,040,863 | 8/1977 | Kitamura | 156/666 |

*Primary Examiner*—Jerome W. Massie

*Attorney, Agent, or Firm*—Margareta LeMaire; Bryant W. Brennan

[57] ABSTRACT

Improved metal dissolution rates are obtained when using a solution containing sulfuric acid, hydrogen peroxide and an effective amount of a mono- or dihydroxy-substituted cycloparaffin.

23 Claims, No Drawings

DISSOLUTION OF METALS UTILIZING A $H_2O_2$-$H_2SO_4$ SOLUTION CATALYZED WITH HYDROXY SUBSTITUTED CYCLOPARAFFINS

The present invention relates to the dissolution of metals in an aqueous bath containing sulfuric acid and hydrogen peroxide, and in particular to a novel bath composition capable of effecting the dissolution at high rates. In one specific aspect the invention is concerned with etching of copper in the production of printed circuit boards.

BACKGROUND OF THE INVENTION

As is well known in the art, in the manufacture of printed electronic circuits a laminate of copper and etch resistant material, usually plastic, is used. A common method of obtaining the circuits is to mask the desired pattern on the copper surface of the laminate with a protective resist material, which is impervious to the action of an etch solution. In a subsequent etching step, the unprotected areas of the copper are etched away, while the masked areas remain intact and provide the desired circuiting supported by the plastic. The resist material can be a plastic material, an ink or a solder.

In the last few years, the industry has more and more turned to hydrogen peroxide-sulfuric acid systems for etching the electronic circuit boards, due to the low cost of the etching solutions and to the relative ease with which copper values can be recovered from the spent etch solutions.

However, there are many problems connected with the use of hydrogen peroxide as an ingredient in the etchants. It is a well known fact that the stability of hydrogen peroxide in a sulfuric acid-hydrogen peroxide solution is detrimentally affected by the presence of heavy metal ions such as copper ions. Thus, as etching proceeds and copper ion content of the etchant thereby increases, the etch rate will experience a serious drop-off due to the decomposition of the hydrogen peroxide in the etch bath, which will soon be exhausted. In order to improve the capacity of these etchants, various stabilizers have been suggested and used with some success for abatement of the hydrogen peroxide decomposition due to the presence of copper ions.

For instance, lower saturated aliphatic alcohols, such as methanol, ethanol, propanol and butanol, are disclosed in U.S. Pat. No. 3,597,290 as useful stabilizing additives to acidified hydrogen peroxide copper etching solutions. A disadvantage of these stabilized solutions is that they are extremely sensitive to the presence of chloride or bromide ions and therefore precautions must be made to remove these ions from the etching system prior to use, e.g. by deionization or by precipitation of the contaminating ions, e.g. with a silver salt. Also, the alcohols are generally quite volatile, at the elevated temperatures required in etching processes, and therefore, substantial losses of the stabilizer are incurred during operation.

Ethylene glycol, either in mono- or poly-form, is another compound which is known to stabilize acidified hydrogen peroxide solutions used in metal dissolution processes such as copper pickling (cf. U.S. Pat. No. 3,537,895) and etching (cf. U.S. Pat. No. 3,773,577). In addition to the stabilizing effect, ethylene glycol also has other advantages in accordance with the teachings of these patents in that it has a relatively low volatility at normal operating temperatures and that it improves the etching and pickling rates somewhat. However, these rates are still not fast enough for many metal dissolution processes, and the problem of chloride and bromide sensitivity is also present with these stabilized metal treating solutions.

Although considerable retardation of the metal ion-induced hydrogen peroxide decomposition can be achieved by the addition of a suitable stabilizer, the etch rates of the stabilized hydrogen peroxide-sulfuric acid etchants have, generally, been quite low and in need of improvement especially at high copper ion concentrations. It has therefore, been suggested in the prior art to add a catalyst or promoter to improve the etch rate. Specific examples of such catalysts are the metal ions disclosed in U.S. Pat. No. 3,597,290, such as silver, mercury, palladium, gold and platinum ions, which all have a lower oxidation potential than that of copper. Other examples include those of U.S. Pat. No. 3,293,093, i.e. phenacetin, sulfathiazole and silver ion, or the various combinations of any of the above three components with dibasic acids, as disclosed in U.S. Pat. No. 3,341,384, or with the phenyl ureas or benzoic acids of U.S. Pat. No. 3,407,141, or with the urea and thiourea compounds of U.S. Pat. No. 3,668,131.

Although silver ions thus appear to provide a universal solution to the above-discussed problem of low etch rates as well as that caused by the presence of free chloride and bromide ion content, there are still some disadvantages had with the use of silver ions in preparing hydrogen peroxide-sulfuric acid etch solutions. One of these is the high cost of silver. Another is that silver ions still do not promote the rate of etching as much as would be desired.

An object of the present invention is therefore to provide a novel, highly efficient aqueous composition for the dissolution of metals.

Another object is to provide an improved method for the dissolution of metals, e.g. copper or alloys of copper, at high rates.

Still another object is to provide a composition and method for etching copper, wherein the etch rates are relatively unaffected by the presence of chloride or bromide ions.

Other objects of the invention will become readily apparent from the detailed description set forth hereinafter.

THE INVENTION

In accordance with the present invention there is provided a composition which comprises an aqueous solution of from about 0.2 to about 4.5 gram moles per liter of sulfuric acid, from about 0.25 to about 8 gram moles per liter of hydrogen peroxide, and an effective amount of a promoter selected from:

(a) monohydroxy or dihydroxy-substituted cycloparaffins containing from 5 to 7 carbon atoms in the ring structure, or (b) monohydroxy or dihydroxy-substituted alkylcycloparaffins containing from 5 to 7 carbon atoms in the ring structure, where each of the alkyl groups contains from 1 to 4 carbon atoms and is attached to an unsubstituted carbon atom in the ring structure.

The sulfuric acid concentration of the solution should be maintained between about 0.2 to about 4.5 gram moles per liter and preferably between about 0.3 and about 4 gram moles per liter. The hydrogen peroxide concentration of the solution should broadly be in the range of from about 0.25 to about 8 gram moles per liter and preferably limited to 1 to about 4 gram moles per liter.

Suitable hydroxy-substituted cycloparaffins useful in the invention are cyclopentanol, cyclohexanol, cycloheptanol, 1,2-cyclopentanediol, 1,3-cyclopentanediol, 1,2-cyclohexanediol, 1,3-cyclohexanediol, 1,4-cyclohexanediol, 1,2-cycloheptanediol, 1,3-cycloheptanediol, 1,4-cycloheptanediol as well as various other alcohols and diols of $C_5$–$C_7$ alkyl-substituted cycloparaffins such as the methylcyclohexanols. The preferred compounds are those, which have no alkyl substitutions in the ring structure.

The above compounds are added to the solution in effective quantities which usually amounts to at least about 0.01 gram moles per liter, preferably between about 0.05 and about 0.5 gram moles/liter.

Water is used to make up the remaining portion of the solutions. No special treatment is required to remove free chloride or bromide from the solution, since the presence of the cyclic alcohols or diols renders sufficient insensitivity to these contaminants, which otherwise would cause a severe decrease in etch rates.

The solutions may also contain other various ingredients such as any of the well known stabilizers used for counteracting heavy metal ion-induced degradation of hydrogen peroxide. Examples of suitable stabilizers include those disclosed in U.S. Pat. Nos. 3,537,895; 3,597,290; 3,649,194; 3,801,512 and 3,945,865. The aforementioned patents are incorporated in this specification by reference. Of course, any of various other compounds having a stabilizing effect on acidified hydrogen-peroxide metal treating solutions can be used with equal advantage.

Also any of the additives known to prevent undercutting, i.e. side or lateral etching, can also be added, if desired. Examples of such compounds are the nitrogen compounds disclosed in U.S. Pat. Nos. 3,597,290 and 3,773,577, both incorporated in this disclosure by reference. However, in the present invention, the use of such additives is not necessary, because of the rapid etch rates obtained due to inclusion of the mono or dihydroxy substituted cycloparaffin promoters in the etching compositions.

The solutions are particularly useful in the chemical milling and etching of copper and alloys of copper, but other metals and alloys may also be dissolved with the solutions of this invention, e.g. iron, nickel, zinc and steel.

When using the solutions to dissolve a metal, conventional operating conditions for the particular metal are employed. Thus, in the etching of copper temperatures between about 105° to about 140° F. should be maintained and preferably the operating temperature should be between about 120° and about 135° F.

The solutions are eminently suited as etchants using either immersion or spray etching techniques. The etch rates obtained with the compositions of the invention are very fast, e.g. etch times in the order of 1 to about 1.5 are typical when etching copper laminates containing one oz/sq. ft copper. Because of these high etch rates the compositions are especially attractive as etchants in the manufacture of printed circuit boards, where it is required that a relatively large number of work pieces be processed per unit time for economical reasons as well as for minimizing detrimental lateral etching or undercutting of the edges under the resist material. Another important advantage of the invention is that clean etchings are achieved. Still another advantage is that presence of free chloride or bromide, e.g. in concentrations of above 2 ppm and up to 50 ppm, can be tolerated in the solutions with only a very slight sacrifice in etch rates. Thus, ordinary tap water can be used in preparing the solutions. Furthermore, the cyclic alcohol and diol promoters of this invention have been found to have a stabilizing effect on the hydrogen peroxide, thereby reducing the need for additional hydrogen-peroxide stabilizers. Also, the etch rates of the solutions are relatively unaffected by high copper loadings.

The following examples are provided as illustration of the invention.

EXAMPLES 1–13

In this set of comparative experiments copper laminates (2"×2") having a coating of one ounce copper per square foot were immersion etched in stirred solutions maintained at 129° F. Each of the 800 ml solutions contained 15 volume percent 66° Baumé sulfuric acid (2.7 gram moles/liter), 15 volume percent (50% w/w) hydrogen peroxide (2.6 gram moles/liter) and 70 volume percent of either deionized or distilled water. The solutions were stabilized with 2.5 grams/liter sodium phenolsulfonate. Without any catalyst and chloride ions present (Example 1) the times required to completely remove the copper from a laminate was 270 seconds (deionized water) and 190 seconds (distilled water).

The etch solutions of Examples 2–13 had the same compositions as that of Example 1, except that they also contained various hydroxy-substituted cycloparaffin compounds as shown in Table 1. The results of the etching tests in Examples 2–10 showed that all of the additives included in the invention had a dramatic effect in improving the etch times required to completely remove the copper from the bottom side of the board, both in the absence of chloride ions or the presence of considerable quantities thereof, i.e. 45 ppm of added chloride ion. The criticality of the invention is demonstrated by the poor results obtained in Examples 11–13, where additives not meeting the requirements of the invention were used.

TABLE I

| Example No. | Additive Name | Additive ml/l(g/l) | Etch Time, Sec. Without $Cl^-$ | Etch Time, Sec. With $Cl^-$ (45 ppm) |
|---|---|---|---|---|
| 1 | — | — | 270(190)[1] | — |
| 2[1] | Cyclopentanol | 20 | 90 | 125 |
| 3 | Cyclohexanol | 20 | 100 | 130 |
| 4[1] | Cycloheptanol | 20 | 95 | 115 |
| 5[1] | 2-Methylcyclohexanol | 20 | 95 | 150 |
| 6[1] | 3-Methylcyclohexanol | 20 | 100 | 140 |
| 7[1] | 4-Methylcyclohexanol | 20 | 110 | 175 |
| 8 | 1,2-Cyclohexanediol | (10) | 90 | 130 |
| 9 | 1,3-Cyclohexanediol | (10) | 90 | 135 |
| 10 | 1,4-Cyclohexanediol | (20) | 95 | 130 |
| 11[1] | Cyclooctanol | 20 | 125 | 350 |
| 12[1] | 1-Methylcyclohexanol | 20 | 85 | 300 |
| 13 | Mesoinositol | (20) | 190 | — |

[1]Distilled water used in preparing solution.

It should be noted that consistently superior results are obtained with the solutions of this invention in large scale operations e.g. by spray etching techniques. Specifically, the increase in etch rate as compared to that of a control solution is much more pronounced and also the actual etch times are substantially lower typically in the order of ⅓ to ⅔ of the values obtained using the small scale immersion technique described above.

EXAMPLES 14–16

In order to demonstrate the stabilizing effect had with the hydroxy-substituted cycloparaffin promoters of this invention a control solution (Example 14) was prepared having the composition of Example 1 and also containing 38.2 g/liter copper ions added in the form of 150 g/l cupric sulfate pentahydrate. The solution was maintained at 129° F. with constant agitation for 24 hours and the peroxide concentration was measured initially and then periodically during the test period.

Examples 15 and 16 were carried in exactly the same fashion except that respectively cyclohexanol and 1,4-cyclohexanediol were also added to the solution. The additions of these promoters resulted in substantial retention of hydrogen peroxide over the entire test periods. The pertinent data are shown in Table II.

TABLE II

| Example No. | Stabilizer | Quantity Added ml/l(g/l) | Vol % $H_2O_2$ (50% w/w) 0 hrs. | 2 hrs. | 20 hrs. | 24 hrs. |
|---|---|---|---|---|---|---|
| 14 | None | — | 14.8 | 10.4 | 0.3 | 0.2 |
| 15 | Cyclo-hexanol | 20 | 15.1 | 13.9 | 7.0 | 6.1 |
| 16 | 1,4-Cyclo-hexanediol | (20) | 15.1 | 13.8 | 5.5 | 4.5 |

EXAMPLES 17–19

Etching tests were carried out in a DEA-30 spray etcher with hydrogen peroxide-sulfuric acid etchants. Copper laminates having a coating of one ounce copper per square foot were treated at 125° C. with the etchants.

The control etch solution (Example 17) contained 20 percent by volume of 66° Baume sulfuric acid (3.5 gram moles/liter), 10 percent by volume of 50 wt % hydrogen peroxide (1.8 gram moles/liter) and 70 percent by volume of deionized water. In addition, the solution contained 30 grams/liter of copper sulfate pentahydrate and 1 gram/liter of sodium phenol sulfonate. The etch time, i.e. the time to completely etch away the copper from a board was 11.0 minutes for the control etch solution of Example 17.

Example 18 was carried out exactly as Example 17 except that to the control solution there was added 1 percent by volume of cyclohexanol. The inclusion of the cyclohexanol in the etch solution resulted in a dramatic decrease in etch time from 11 minutes to about 43 seconds, i.e. the etch rate was increased about 13 fold. The same low etch rate was observed in Example 19, where 2 percent by volume of cyclohexanol was added to the control etch solution.

It is obvious to those skilled in the art that many variations and modifications can be made to the specific embodiments discussed above. All such departures from the foregoing specification are considered within the scope of this invention as defined by this specification and the appended claims.

What is claimed is:

1. In a process for the dissolution of metal in which a metal is contacted with an aqueous solution containing from about 0.2 to about 4.5 gram moles per liter of sulfuric acid, from about 0.25 to about 8 gram moles per liter of hydrogen peroxide, the method of increasing the metal dissolution rate of the solution to a value higher than that obtained by such a solution free of any chloride and bromide ions, which method comprises adding at least about 0.085 and up to 0.5 gram moles per liter of the solution of a promoter selected from:

(a) monohydroxy or dihydroxy-substituted cycloparaffins containing from 5 to 7 carbon atoms in the ring structure, or (b) monohydroxy or dihydroxy-substituted alkylcycloparaffins containing from 5 to 7 carbon atoms in the ring structure, where each of the alkyl groups contains from 1 to 4 carbon atoms and is attached to an unsubstituted carbon atom in the ring structure.

2. The method of claim 1, wherein the aqueous solution contains sodium phenolsulfonate as a stabilizer to reduce the degrading effect of heavy metal ions on hydrogen peroxide.

3. The method of claim 1, wherein the hydrogen peroxide concentration is maintained between about 1 and about 4 gram moles per liter.

4. The method of claim 1, wherein the sulfuric acid concentration is maintained between about 0.3 and about 4 gram moles per liter.

5. The method of claim 1, wherein the promoter is cyclopentanol.

6. The method of claim 1, wherein the promoter is cyclohexanol.

7. The method of claim 1, wherein the promoter is cycloheptanol.

8. The method of claim 1, wherein the promoter is 1,2-cyclohexanediol.

9. The method of claim 1, wherein the promoter is 1,3-cyclohexanediol.

10. The method of claim 1, wherein the promoter is 1,4-cyclohexanediol.

11. The method of claim 1, wherein the metal is copper or an alloy of copper.

12. The method of claim 1 carried out in the presence of chloride or bromide ions in excess of 2 ppm and up to 50 ppm.

13. In a composition for metal dissolution comprising an aqueous solution of from about 0.2 to about 4.5 gram moles per liter of sulfuric acid and from about 0.25 to about 8 gram moles per liter of hydrogen peroxide, the addition of at least about 0.085 and up to 0.5 gram moles per liter of a promoter for increasing metal dissolution rate of the solution to a value higher than that obtained by such a solution free of any chloride or bromide ions, which promoter is selected from:

(a) monohydroxy or dihydroxy-substituted cycloparaffins containing from 5 to 7 carbon atoms in the ring structure, or (b) monohydroxy or dihydroxy-substituted alkylcycloparaffins containing from 5 to 7 carbon atoms in the ring structure, where each of the alkyl groups contains from 1 to 4 carbon atoms and is attached to an unsubstituted carbon atom in the ring structure.

14. The composition of claim 13, additionally containing sodium phenosulfonate as a stabilizer for reducing the degrading effect of heavy metal ions on hydrogen peroxide.

15. The composition of claim 13, wherein the hydrogen peroxide concentration is maintained between about 1 and about 4 gram moles per liter.

16. The composition of claim 13, wherein the sulfuric acid concentration is maintained about 0.3 and about 4 gram moles per liter.

17. The composition of claim 13, wherein the promoter is cyclopentanol.

18. The composition of claim 13, wherein the promoter is cyclohexanol.

19. The composition of claim 13, wherein the promoter is cycloheptanol.

20. The composition of claim 13, wherein the promoter is 1,2-cyclohexanediol.

21. The composition of claim 13, wherein the promoter is 1,3-cyclohexanediol.

22. The composition of claim 13, wherein the promoter is 1,4-cyclohexanediol.

23. The composition of claim 13 containing free chloride or bromide ions in excess of 2 ppm and up to about 50 ppm.

* * * * *